US007636539B2

(12) United States Patent
Kawasaki et al.

(10) Patent No.: US 7,636,539 B2
(45) Date of Patent: Dec. 22, 2009

(54) TANDEM INTERMEDIATE-TRANSFER TYPE IMAGE FORMING APPARATUS

(75) Inventors: Akihiro Kawasaki, Hyogo (JP); Atsushi Takehara, Kyoto (JP); Yoshie Iwakura, Osaka (JP); Takafumi Miyazaki, Osaka (JP); Tomoya Adachi, Osaka (JP)

(73) Assignee: Ricoh Company Limited, Tokyo (JP)

( * ) Notice: Subject to any disclaimer, the term of this patent is extended or adjusted under 35 U.S.C. 154(b) by 457 days.

(21) Appl. No.: 11/411,128

(22) Filed: Apr. 26, 2006

(65) Prior Publication Data

US 2006/0257176 A1 Nov. 16, 2006

(30) Foreign Application Priority Data

Apr. 27, 2005 (JP) ..... 2005-129549

(51) Int. Cl.
*G03G 15/01* (2006.01)

(52) U.S. Cl. ..... 399/299; 399/302; 399/308; 399/313

(58) Field of Classification Search ..... 399/299, 399/302, 308, 313
See application file for complete search history.

(56) References Cited

U.S. PATENT DOCUMENTS

| | | | | |
|---|---|---|---|---|
| 6,021,287 | A * | 2/2000 | Tanaka | 399/299 |
| 6,850,726 | B1 * | 2/2005 | Mizuno et al. | 399/299 |
| 2002/0041771 | A1 * | 4/2002 | Katayanagi et al. | 399/302 |
| 2004/0228659 | A1 * | 11/2004 | Nishida | 399/313 |
| 2005/0058473 | A1 * | 3/2005 | Mizuno et al. | 399/302 |

FOREIGN PATENT DOCUMENTS

| | | |
|---|---|---|
| JP | HEI 7-043976 | 2/1995 |
| JP | HEI 8-305184 | 11/1996 |
| JP | 2001-183916 | 7/2001 |
| JP | 2002-243007 | 8/2002 |
| JP | 2003-029493 | 1/2003 |

* cited by examiner

*Primary Examiner*—David M Gray
*Assistant Examiner*—Laura K Roth
(74) *Attorney, Agent, or Firm*—Harness, Dickey & Pierce, P.L.C.

(57) ABSTRACT

An image forming unit includes four photoconductors, a belt extended around a driving roller and an extension-cum-primary transfer roller. Three primary transfer rollers sandwich the belt in association with a corresponding photoconductor. The extension-cum-primary transfer roller serves both as an extension roller and a primary transfer roller.

13 Claims, 3 Drawing Sheets

TANDEM INTERMEDIATE-TRANSFER TYPE IMAGE FORMING APPARATUS

CROSS-REFERENCE TO RELATED APPLICATIONS

The present document incorporates by reference the entire contents of Japanese priority document, 2005-129549 filed in Japan on Apr. 27, 2005.

BACKGROUND OF THE INVENTION

1. Field of the Invention

The present invention generally relates to a tandem-type image forming apparatus and particularly relates to an intermediate transfer type image forming apparatus.

2. Description of the Related Art

Tandem-type color image forming apparatuses, which have a plurality of photoconductors, are more efficient because they can output more pages per unit time. However, the tandem-type color image forming apparatuses have a disadvantage that, when superimposing all the monochrome toner images formed on the photoconductors on one another to form a full-color image, it is difficult to align writing positions of the toner images. If the writing positions are not aligned correctly, the image quality degrades.

Two types of tandem-type color image forming apparatuses are known: a direct transfer type and an intermediate transfer type. In the direct transfer type, toner images are directly transferred from the photoconductors onto a final transfer material. In the intermediate transfer type, toner images are first transferred from the photoconductors onto an intermediate transfer member, and then onto the final transfer material. The final transfer material is, for example, a paper.

It is easier to correctly align the writing positions of the toner images in the intermediate transfer type than in the direct transfer type. This is because, the toner images are first transferred onto the intermediate transfer member of a certain material in the intermediate transfer type, whereas the toner images are transferred onto various transfer materials in the direct transfer type.

Because the tandem-type color image forming apparatus includes a plurality of photoconductors, the direct transfer type requires a longer transfer material conveying belt and the intermediate transfer type requires a longer intermediate transfer belt than when there is only one photoconductor. Moreover, the belts are extended around a plurality of rollers, which makes the structure complex.

Japanese Patent Application Laid Open No. H8-305184 discloses a direct transfer type image forming apparatus in which a driving roller and a subordinate roller are made to serve as transfer charging rollers whereby the number of rollers can be reduced and a shorter transfer material conveying belt can be used. However, the issue of difficulty in aligning the toner images remains unsolved.

Japanese Patent Application Laid Open No. H7-43976 discloses an image forming apparatus including four fan-shaped image forming units for black, yellow, magenta, and cyan, arranged in a circular ring, which transfer toner images onto an intermediate transfer belt at a single primary transfer position. Moreover, a subordinate roller is caused to function as a transfer charging roller. As a result, the number of rollers can be reduced, and a shorter transfer material conveying belt can be used. Moreover, because there is only one primary transfer position, costs are reduced and the apparatus can be made compact. However, there is a disadvantage that the output capacity of color images per unit time is small.

SUMMARY OF THE INVENTION

It is an object of the present invention to at least partially solve the problems in the conventional technology.

According to an aspect of the present invention, an image forming apparatus includes a belt that rotates around a plurality of rollers; a plurality of image carriers configured to carry toner images, the image carriers arranged in contact with a first side of the belt at a plurality of primary transfer positions; a plurality of primary transfer members arranged in contact with a second side of the belt opposite to the first side, wherein each primary transfer member applies a voltage to a corresponding one of the primary transfer positions so that toner images on each image carrier are sequentially transferred onto the belt to be superposed on one another and then transferred at once onto a transfer material at a secondary transfer position, wherein at least one of the rollers serves as at least one of the primary transfer members.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
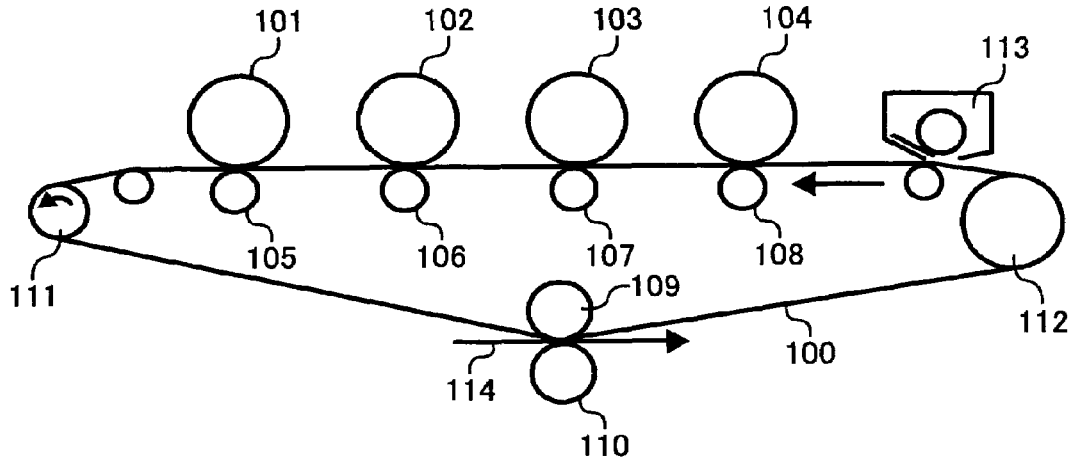
FIG. 1 is a schematic of an arrangement of a conventional image forming apparatus.

FIG. 1 is a schematic for explaining a conventional image forming apparatus. The image forming apparatus includes an image forming unit including four photoconductors 101 to 104. An intermediate transfer belt 100 is extended around a driving roller 111 that drives the intermediate transfer belt 100, an extension roller 112, and a pair of secondary transfer rollers 109 and 110. Four primary transfer rollers 105 to 108 sandwich the intermediate transfer belt 100 in association with a corresponding one of the photoconductors 101 to 104. Predetermined voltages are applied onto the primary transfer rollers 105 to 108 so that monochrome toner images formed on each of the photoconductors 104 to 101 are superposed in that order onto the intermediate transfer belt 100 to form a full-color image. Subsequently, the color image on the intermediate transfer belt 100 is transferred onto a sheet 114 of paper, which is a transfer material, by applying a predetermined voltage onto the secondary transfer roller 110. The color image is fixed onto the sheet 114 by a fixing unit (not shown), and the sheet 114 is output. Excess toner remaining on the intermediate transfer belt 100, which was not transferred onto the sheet 114 of paper by secondary transfer roller 110, is collected by a toner cleaning unit 113. The toner cleaning unit 113 is, for example, a blade.

Figure 2:
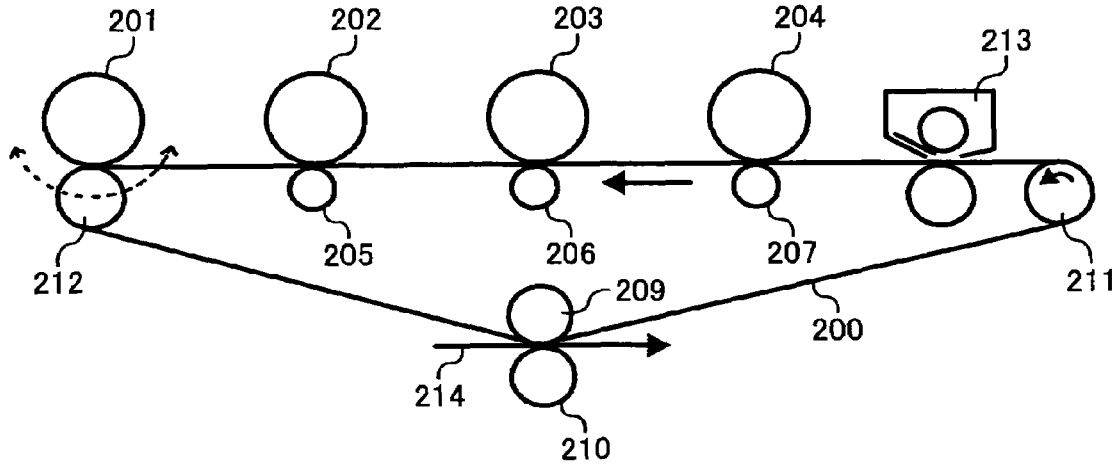
FIG. 2 is a schematic of an arrangement of a first embodiment according to the present invention.

FIG. 2 is a schematic of an arrangement according to a first embodiment of the present invention. An image forming unit according to the first embodiment includes four photoconductors 201 to 204. An intermediate transfer belt 200 is extended around a driving roller 211 that drives the intermediate transfer belt 200, an extension-cum-primary transfer roller 212, and a pair of secondary transfer rollers (secondary transfer members) 209 and 210. Three primary transfer rollers 205 to 207 sandwich the intermediate transfer belt 200 in association with a corresponding photoconductor among the photoconductors 202 to 204. Predetermined voltages are applied to the primary transfer rollers 205 to 207 so that three monochrome toner images on the photoconductors 204, 203, and 202 are superposed, in that order, onto the intermediate transfer belt 200 to form a three-color image. According to the first embodiment, the extension-cum-primary transfer roller 212 serves both as an extension roller and a primary transfer roller. In other words, in addition to functioning as an extension roller, the extension-cum-primary transfer roller 212 corresponds to a primary transfer roller for the photoconductor 201.

A predetermined voltage is applied to the extension-cum-primary transfer roller 212, so that the toner image on the photoconductor 201 is transferred to the intermediate transfer belt 200 an superimposed onto the three-color image, thereby forming a full-color image. Subsequently, in the same manner as the conventional example, the color image formed on the intermediate transfer belt 200 is transferred onto a sheet 214 of paper, which is a transfer material, by applying a predetermined voltage onto the secondary transfer roller 210. The color image is fixed by a fixing unit (not shown) onto the sheet 214, and the sheet 214 is output. Excess toner remaining on the intermediate transfer belt 200, which was not transferred onto the sheet 214 by the secondary transfer roller 210, is collected by a toner cleaning unit 213. The toner cleaning unit 213 is, for example, a blade.

Because the intermediate transfer belt 200 is always under tension, its length can change over time. Changes in the length of the intermediate transfer belt 200 can be compensated by rotating the driving roller 211 along a circumference of a driving gear or rotating the extension-cum-primary transfer roller 212 along a circumference of the photoconductor 201.

An arrangement is shown in FIG. 2 in which one roller, i.e., the extension-cum-primary transfer roller 212, functions as a primary transfer roller; however, two or more of the rollers 212, 205, 206, and 207 can be made to function as primary transfer rollers.

According to the first embodiment, at least one roller functions as both the primary transfer roller and the extension roller so that at least one roller can be omitted, thereby reducing cost. Moreover, a shorter intermediate transfer belt can be used, thereby reducing cost and size of an image forming apparatus.

Figure 3:
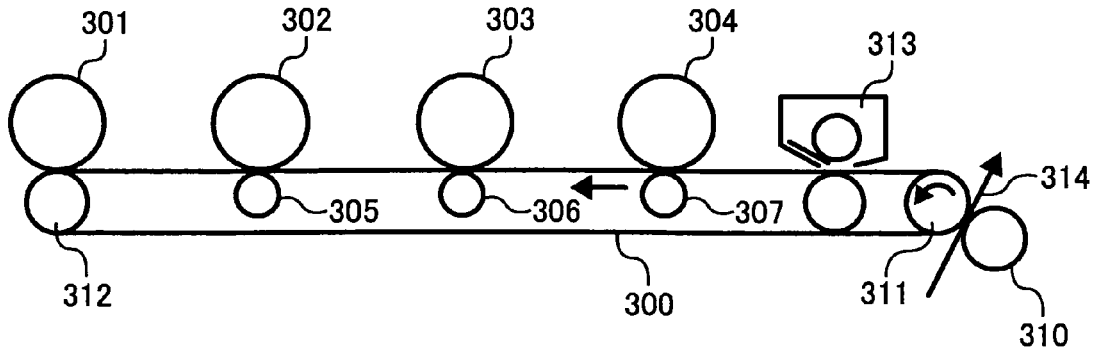
FIG. 3 is a schematic of an arrangement of a second embodiment according to the present invention.

FIG. 3 is a schematic of an arrangement according to a second embodiment of the present invention. The secondary transfer roller 209 in the first embodiment shown in FIG. 2 is omitted in the second embodiment. Instead, a driving roller is made to serve as a secondary transfer roller.

An image forming unit according to the second embodiment includes four photoconductors 301 to 304. An intermediate transfer belt 300 is extended around an extension-cum-driving roller 311 that drives the intermediate transfer belt 300, and an extension-cum-primary transfer roller 312. Three primary transfer rollers 305 to 307 sandwich the intermediate transfer belt 300 in association with a corresponding one of the photoconductors 302 to 304. The extension-cum-primary transfer roller 312 serves both as an extension roller and a primary transfer roller. In other words, in addition to functioning as an extension roller, the extension-cum-primary transfer roller 312 corresponds to a primary transfer roller for the photoconductor 301. According to the second embodiment, the extension-cum-driving roller 311 serves both as an extension roller and a secondary transfer roller in association with a secondary transfer roller (secondary transfer member) 310. A color image formed on the intermediate transfer belt 300 is transferred onto a sheet 314 of paper, which is a transfer material, by applying a predetermined voltage onto the secondary transfer roller 310. Excess toner remaining on the intermediate transfer belt 300 is collected by a toner cleaning unit 313.

Changes in the length of the intermediate transfer belt 300 can be compensated by rotating the extension-cum-primary transfer roller 212 along a circumference of the photoconductor 201.

According to the second embodiment, at least one roller functions as both the primary transfer roller and the extension roller, and one roller functions as the driving roller and the secondary transfer opposite roller. Thus, at least two rollers can be omitted, thereby further reducing cost. Moreover, a shorter intermediate transfer belt can be used, thereby reducing cost and size of an image forming apparatus.

Figure 4:
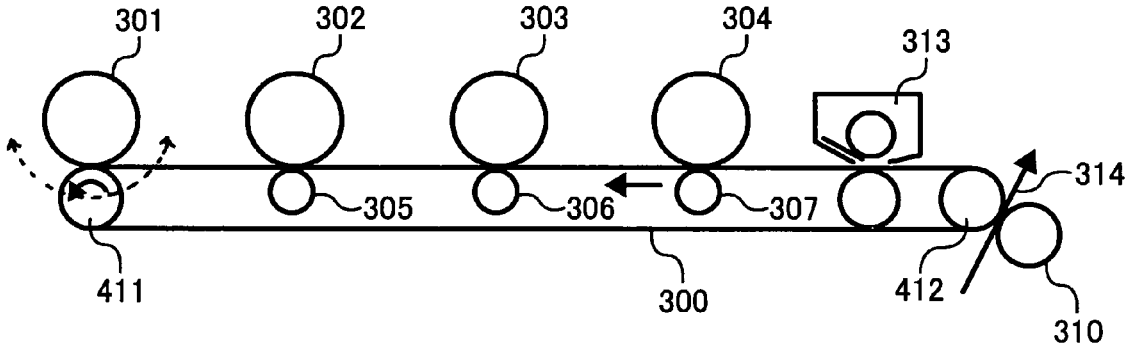
FIG. 4 is a schematic of an arrangement of a third embodiment according to the present invention.

FIG. 4 is a schematic of an arrangement according to a third embodiment of the present invention. The third embodiment is different from the second embodiment in that an extension-cum-secondary transfer roller 412 serves as a secondary transfer roller (secondary transfer member) in association with the secondary transfer roller 310, and an extension-cum-driving roller 411 serves as a primary transfer roller. The rest of the configuration is the same as that shown in FIG. 3.

Changes in the length of the intermediate transfer belt 300 can be compensated by rotating the extension-cum-driving roller 411 along a circumference of the photoconductor 301.

According to the third embodiment, at least one roller functions as both the primary transfer roller and the driving roller, and one roller functions as the extension roller and the secondary transfer opposite roller. Thus, at least two rollers can be omitted, thereby further reducing cost. Moreover, a shorter intermediate transfer belt can be used, thereby reducing cost and size of an image forming apparatus.

A fourth embodiment according to the present invention is described with reference to FIG. 3. If the extension-cum-primary transfer roller 312 is made of a hard material such as metal, the intermediate transfer belt 300 slips on the extension-cum-primary transfer roller 312, which causes a defective transfer of images, i.e., an image is not properly transferred. Accordingly, it is preferable that the extension-cum-primary transfer roller 312 is coated with an elastic layer that is sufficiently hard. Otherwise, the intermediate transfer belt 300 cannot be rotated stably, which causes color misalignments.

Assume that the photoconductors 301 to 304 each have a diameter of 24 millimeters (mm), distance between any two adjacent photoconductors is 53.4 mm, and the extension-cum-driving roller 311 and the extension-cum-primary transfer roller 312 respectively have diameters of 17 mm. Then, the extension-cum-driving roller 311 and the extension-cum-primary transfer roller 312 have a metal core with a diameter of 16 mm coated with an elastic layer of 0.5 mm, so that the outer diameters of the rollers become 17 mm. Table 1 depicts experiment results of defective transfer and color misalignments at different hardness levels of rubber of the elastic layer. When the ASKER C hardness of the elastic layer exceeds 50 degrees, a defective transfer occurs, and when the ASKER C hardness is below 30 degrees, color misalignment occurs. In other words, neither defective transfer nor color misalignment occur when the ASKER C hardness of the elastic layer is between 30 degrees and 50 degrees. The standard of color misalignment is an average+3s=200 micrometers, where s is a standard deviation.

TABLE 1

| | ASKER C hardness (degree) | | | | | |
|---|---|---|---|---|---|---|
| | 20 | 30 | 40 | 50 | 60 | 70 |
| Defective transfer | A | A | A | A | M | M |
| Color misalignment | M | A | A | A | A | A |

M: moderate,
A: almost not observed

Therefore, it is preferable that an elastic layer having the ASKER C hardness of 30 degrees to 50 degrees is provided on the extension-cum-primary transfer roller 312 so that defective transfer and color misalignment can be prevented from occurring and the image quality is improved. The elastic layer can be made of ethylene-propylene diene monomer (EPDM), nitrile butadiene rubber (NBR), etc.

The same effects can be achieved by applying the technique of the fourth embodiment to the third embodiment shown in FIG. 4. In other words, an elastic layer having the ASKER C hardness of 30 degrees to 50 degrees can be provided on the extension-cum-driving roller 411.

Figure 5:
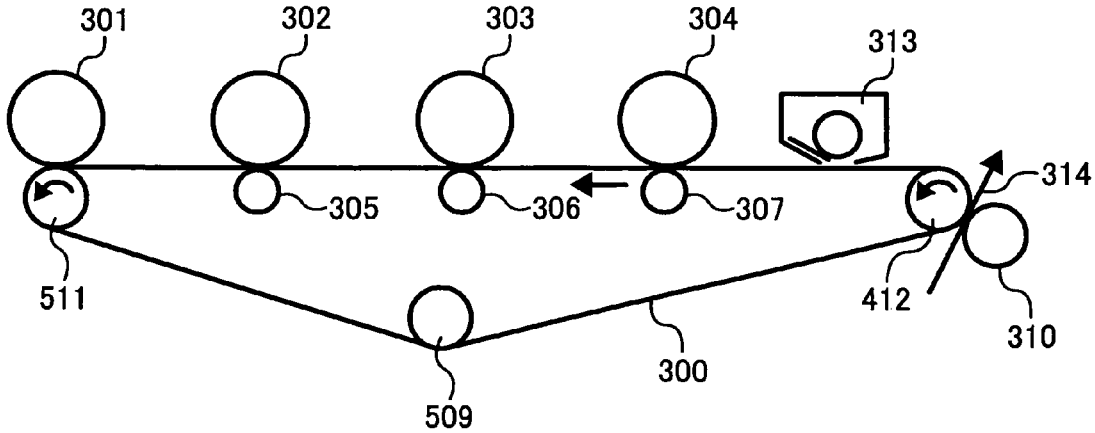
FIG. 5 is a schematic of an arrangement of a fifth embodiment according to the present invention.

A fifth embodiment according to the present invention is described with reference to FIG. 5. In the fourth embodiment an elastic layer having the ASKER C hardness of 30 degrees to 50 degrees is provided on the extension-cum-primary transfer roller 312 (or the extension-cum-driving roller 411) thereby almost preventing occurrence of color misalignment. In the fifth embodiment, an extension-cum-primary transfer roller 511 is arranged at a position shifted, for example, by 7 mm from a photoconductor 301 to a downstream side in a direction of movement of the intermediate transfer belt 300, and the photoconductor 301 is shifted, for example, by 0.5 mm toward the intermediate transfer belt 300 so that the photoconductor 301 pushes down the intermediate transfer belt 300. Moreover, an extension roller 509 is provided. Accordingly, a transfer nip is formed between the intermediate transfer belt 300 and the photoconductor 301, i.e., the extension-cum-primary transfer roller 511 does not apply pressure directly or via the intermediate transfer belt 300 on the photoconductor 301. Therefore, it is possible to set the hardness of the extension-cum-primary transfer roller 511 without considering a defective transfer.

Amounts of the shifts can be arbitrarily set so that the interval between the photoconductor 301 and the extension-cum-primary transfer roller 511 exceeds the thickness of the intermediate transfer belt 300.

A sixth embodiment according to the present invention is described with reference to FIG. 5. The same experiment as that of the fourth embodiment was conducted, and Table 2 depicts experiment results. A target standard of color misalignment for a high quality image is an average+3s=120 micrometers. Results show that the hardness of the extension-cum-primary transfer roller 511 does not affect the image transfer, and particularly high quality images can be obtained by setting the hardness at 50 degrees or more.

TABLE 2

| | ASKER C hardness | | | | | |
|---|---|---|---|---|---|---|
| | 20 | 30 | 40 | 50 | 60 | 70 |
| Defective transfer | A | A | A | A | A | A |
| Color misalignment | M | A | A | A | N | N |

M: moderate,
A: almost not observed,
N: not observed

Assume that the photoconductors 301 to 304 each have a diameter of 24 mm, distance between any two adjacent photoconductors is 53.4 mm, and the extension-cum-primary transfer roller 511 and the extension-cum-secondary transfer roller 412 respectively have diameters of 17 mm. Then, the extension-cum-primary transfer roller 511 and the extension-cum-secondary transfer roller 412 have a metal core with a diameter of 16 mm coated with an elastic layer of 0.5 mm, so that the outer diameters of the rollers become 17 mm.

According to the sixth embodiment, an elastic layer having the ASKER C hardness of 50 degrees or more is provided on the extension-cum-primary transfer roller 511. As a result, defective transfer and color misalignment can be prevented from occurring so that image quality can be improved. The elastic layer can be made of EPDM, NBR, etc.

Even when a metal roller was used as the extension-cum-primary transfer roller 511, high quality images were obtained without much color misalignment.

Figure 6:
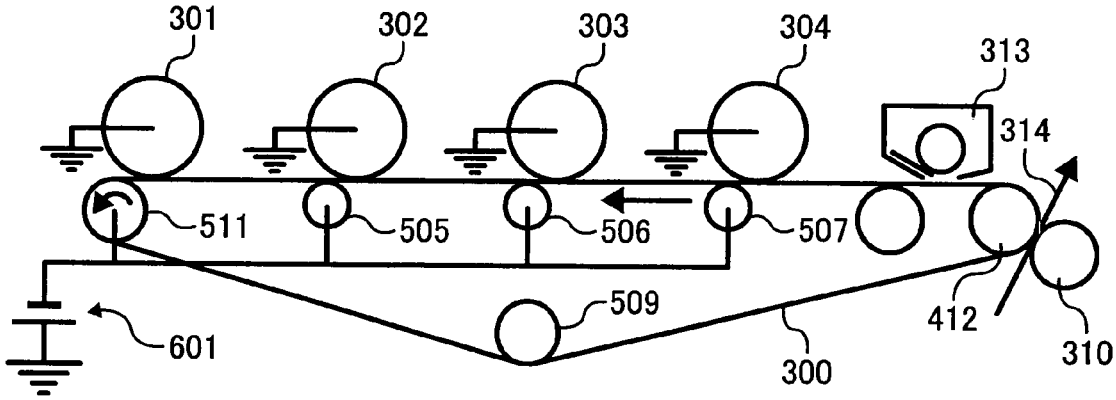
FIG. 6 is a schematic of an arrangement of a seventh embodiment according to the present invention.

A seventh embodiment according to the present invention is described with reference to FIG. 6. In the seventh embodiment, primary transfer rollers 505 to 507 corresponding to the photoconductors 302 to 304 and the photoconductors 302 to 304 are also shifted in the same manner and as the extension-cum-primary transfer roller 511 and the photoconductor 301 by substantially the same amount as those of the extension-cum-primary transfer roller 511 and the photoconductor 301 described in the fifth embodiment shown in FIG. 5. Furthermore, a power source 601 applies the same amount of voltage to the primary transfer rollers 505 to 507 and the extension-cum-primary transfer roller 511. The rest of the structure is the same as that shown in FIG. 5.

Because all primary transfer rollers and all photoconductors are shifted by substantially the same amount, the amount of voltage drop onto the intermediate transfer belt 300 is the same at each primary transfer position. As a result, the same transfer electric field is formed and substantially a transfer nip having substantially the same width is formed at each primary transfer position, so that images can be transferred properly.

As a result, at least two rollers can be omitted and a shorter intermediate transfer belt can be used thereby reducing cost. Furthermore, a transformer of the power source can be integrated, thereby further reducing cost.

The amounts of shift are substantially the same at all primary transfer positions in the seventh embodiment. However, when a toner is employed that easily changes in charge amount when transferred, each of the primary transfer rollers can be shifted by an appropriate amount, so as to control the amount of voltage drop and set an optimum transfer electric field for each color. Furthermore, each of the photoconductors can be shifted by an appropriate amount to control the transfer nip, so that images can be transferred properly.

Figure 7:
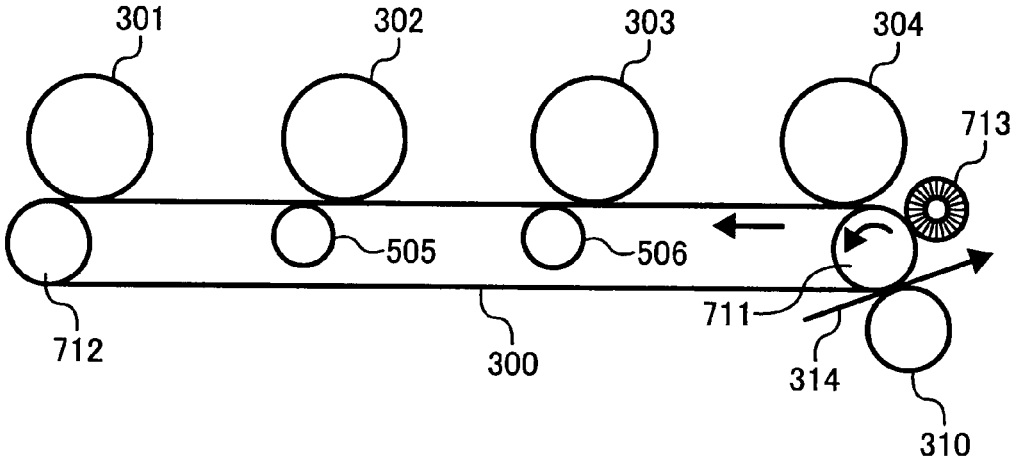
FIG. 7 is a schematic of an arrangement of an eighth embodiment according to the present invention.

FIG. 7 is a schematic of an arrangement according to an eighth embodiment of the present invention. In the eighth embodiment, an extension-cum-primary transfer roller 712 is arranged at a position shifted by 7 mm from the photoconductor 301 toward a downstream side in a direction of movement of the intermediate transfer belt 300, and the photoconductor 301 is shifted by 0.5 mm toward the intermediate transfer belt 300 so as to push the intermediate transfer belt 300. Furthermore, the extension-cum-primary transfer roller 711 is arranged at a position shifted by 7 mm from the photoconductor 304 to an upstream side in the direction of movement of the intermediate transfer belt 300, and the photoconductor 304 is shifted by 0.5 mm toward the intermediate transfer belt 300 so as to push the intermediate transfer belt 300. A toner cleaning unit 713 is arranged opposite to the extension-cum-primary transfer roller 711. The toner cleaning unit 713 is, for example, a brush.

Accordingly, the arrangement only includes a total of four rollers, i.e., two extension rollers and also serving as primary transfer rollers, and two rollers used exclusively as primary transfer rollers. Compared to the conventional technology employing eight rollers, costs can be largely reduced, and an image forming apparatus can be made compact.

Furthermore, by relatively shifting the photoconductors 302, 303 or the primary transfer rollers 505, 506 in the same manner and by substantially the same amount as those of the photoconductor 301 and the extension-cum-primary transfer roller 712, the same voltage is applied at each primary transfer position. By setting the voltage of the toner cleaning unit 713 and the secondary transfer roller 310 based on the primary transfer voltage, costs of the power source can be reduced.

The extension-cum-primary transfer roller 712 can be arranged at a position directly opposite to the photoconductor 301, so that the length of the intermediate transfer belt 300 can be further reduced.

According to an aspect of the present invention, tandem-type color image forming apparatuses can be made compact, and can produce high quality images free of color registration at high speed and at lower cost.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a belt that rotates around a plurality of rollers;

a plurality of image carriers configured to carry toner images, the image carriers arranged in contact with a first side of the belt at a plurality of primary transfer positions;

a plurality of primary transfer members arranged in contact with a second side of the belt opposite to the first side, wherein each primary transfer member applies a voltage to a corresponding one of the primary transfer positions so that toner images on each image carrier are sequentially transferred onto the belt to be superposed on one another and then transferred at once onto a transfer material at a secondary transfer position, wherein at least one of the primary transfer members serves as an extension roller, the extension roller configured to compensate for changes in the length of the belt by rotating along a circumference of one of the plurality of image carriers.

2. The image forming apparatus according to claim 1, further comprising a secondary transfer member configured to apply a voltage to the secondary transfer position, wherein at least one of the rollers serves as an electrode opposite to the secondary transfer member.

3. The image forming apparatus according to claim 2, wherein one of the primary transfer members serves as the secondary transfer member.

4. The image forming apparatus according to claim 1, wherein at least one of the rollers serves as one of the primary transfer members and a driving unit that drives the belt.

5. The image forming apparatus according to claim 1, wherein the roller serving as the primary transfer member is electrically conductive, and is coated with an elastic layer of an asker C hardness of 30 degrees to 50 degrees.

6. The image forming apparatus according to claim 5, wherein a voltage of a same magnitude is applied to the roller serving as the primary transfer member and at least one of the primary transfer members other than the roller serving as the primary transfer member.

7. The image forming apparatus according to claim 1, wherein a point of contact of the roller serving as the primary transfer member and the belt is shifted from a point of contact of the image carrier and the belt of a corresponding primary transfer position.

8. The image forming apparatus according to claim 7, wherein the roller serving as the primary transfer member is electrically conductive, and is coated with an elastic layer of an asker C hardness of 50 degrees or more.

9. The image forming apparatus according to claim 7, wherein a point of contact of the roller serving as the primary transfer member located far upstream in a direction of movement of the belt and the belt is shifted upstream from a point of contact of the image carrier and the belt of a corresponding primary transfer position, and a point of contact of the roller serving the primary transfer member located far downstream in the direction of movement of the belt and the belt is shifted downstream from a point of contact of the image carrier and the belt at a corresponding primary transfer position.

10. An image forming apparatus comprising:

a belt that rotates around a plurality of rollers;

a plurality of image carriers configured to carry toner images, the image carriers arranged in contact with a first side of the belt at a plurality of primary transfer positions;

a plurality of primary transfer members arranged in contact with a second side of the belt opposite to the first side, wherein each primary transfer member applies a voltage to a corresponding one of the primary transfer positions so that toner images on each image carrier are sequentially transferred onto the belt to be superposed on one another and then transferred at once onto a transfer material at a secondary transfer position, wherein at least one of the primary transfer members serves as an extension-cum-driving roller, the extension-cum-driving roller configured to drive the belt and compensate for changes in the length of the belt by rotating along a circumference of one of the plurality of image carriers.

11. The image forming apparatus according to claim 10, further comprising a secondary transfer member configured to apply a voltage to the secondary transfer position, wherein at least one of the rollers serves as an electrode opposite to the secondary transfer member.

12. The image forming apparatus according to claim 10, wherein the rollers serving as the primary transfer members are electrically conductive, and is coated with an elastic layer of an asker C hardness of 30 degrees to 50 degrees.

13. The image forming apparatus according to claim 10, wherein points of contact of the rollers serving as the primary transfer members and the belt are shifted from points of contact of the image carrier and the belt of a corresponding primary transfer position.

* * * * *